US005351721A

United States Patent [19]

Sawada et al.

[11] Patent Number: 5,351,721

[45] Date of Patent: Oct. 4, 1994

[54] MISPICKED WEFT REMOVING METHOD

[75] Inventors: Shigeharu Sawada, Kanazawa; Satoshi Azuma, Matto; Yoshinobu Tobe, Ishikawa, all of Japan

[73] Assignee: Tsudakoma Kogyo Kabushiki Kaisha, Ishikawa, Japan

[21] Appl. No.: 79,786

[22] Filed: Jun. 22, 1993

[30] Foreign Application Priority Data

Jun. 26, 1992 [JP] Japan ..... 4-191388
Jun. 26, 1992 [JP] Japan ..... 4-191389

[51] Int. Cl.[5] ..... D03D 47/30
[52] U.S. Cl. ..... 139/116.2
[58] Field of Search ..... 139/116.2

[56] References Cited

U.S. PATENT DOCUMENTS 4,967,803 11/1990 Kalina et al. ..... 139/116.2
4,974,640 12/1990 Shaw ..... 139/116.2
4,989,645 2/1991 Velechovsky ..... 139/116.2
5,209,271 5/1993 Takegawa ..... 139/116.2

*Primary Examiner*—Andrew M. Falik
*Attorney, Agent, or Firm*—Wenderoth, Lind & Ponack

[57] ABSTRACT

When mispicking occurs, a weft yarn continuous with a mispicked weft yarn is inserted into the shed of warp yarns in a loop by the jetting of a main picking nozzle and auxiliary picking nozzles. A weft yarn retaining member is positioned in the loop of the weft yarn and the mispicked weft yarn is pulled to be removed from the picking side by way of the weft yarn. Given auxiliary picking nozzles stop jetting when the weft yarn is inserted in a loop so that the tip end of the loop of the inserted weft yarn is limited in the extent to which it moves in the picking direction, and thus does not extend substantially beyond the arriving side of the shed of warp yarns, so as to prevent entanglement thereof with various other members.

7 Claims, 9 Drawing Sheets

MISPICKED WEFT REMOVING METHOD

BACKGROUND OF THE INVENTION

1. Field of the Invention

The present invention relates to a method of removing a mispicked weft in a shed by inserting a weft yarn continuous with the mispicked weft from the picking side.

2. Description of the Prior Art

The present applicant proposed a basic method of removing a mispicked weft in the shed of warp yarns by inserting the same from the picking side in Japanese Patent Application No. 2-418684 (U.S. Pat. No. 5,209,271 and European Patent Application No. 91 121 839.4), wherein a weft yarn continuous with the mispicked weft yarn is inserted in to the same shed as the mispicked weft yarn in a U-shaped loop, a weft yarn retaining member serving as a yarn guide as is inserted into the looped weft yarn, and thereafter the weft yarn is pulled from the picking side so as to remove the mispicked weft yarn connected therewith. A main nozzle and all auxiliary picking nozzles jet a picking fluid during picking, and a part of the mispicked weft yarn on the picking side is peeled off the cloth fell.

According to the technique set forth above, however, since the mispicked weft yarns are not equally peeled off the cloth fell, the picked weft yarn is transferred more than necessary depending on the distance by which the mispicked weft yarn is peeled off the cloth fell even if the inserting length is regulated, so that it is liable to be caught by a member such as a weft feeler, a feeler cable or a saddle on the arriving side, and consequently it is liable to be broken when it is further pulled after being caught thereby, which results in an uncertain removal operation of the mispicked weft yarn.

Although a countermeasure to insert a weft yarn short enough to remain in the shed of the warp yarns can be considered, it is not practicable, for the following reasons. That is, the end of the looped weft yarn on the side of the mispicked weft yarn is preferably close to the arriving side when inserting is completed in order to form a wide-open U-shaped loop of the weft yarn so as to facilitate the entry of the retaining member adjacent to the picking side into the loop. In other words, the mispicked weft yarn is preferably peeled off the cloth fell to some extent in picking, but when only a short weft yarn is inserted, the auxiliary picking nozzle does not apply a sufficient picking force to the weft yarn in the shed so that the mispicked weft yarn is not peeled off sufficiently toward the arriving side and the end of the looped weft yarn to be inserted cannot arrive at the vicinity of the arriving side. As a result, the weft yarn should be inserted more than a minimum length. This is a first problem.

Moreover, it is described that a weft yarn guide is indispensable for performing the aforementioned method in order to reverse the pulling direction of the mispicked weft yarn to the direction reverse to that of pulling the weft yarn. For this purpose, the weft yarn guide has to be inserted in the preparatory stage of removing the mispicked weft yarn by an inserting means such as an air cylinder or the like, which results in a complicated construction. This is a second problem.

SUMMARY OF THE INVENTION

It is a first object of the present invention to solve the first problem, i.e., preventing members provided outside of the shed of the warp yarns from interfering with the inserted weft yarn so as to perform the mispicked weft yarn removing operation with certainty by inserting the weft yarn while limiting the extent to which the tip end of the weft yarn moves in the picking direction toward the arriving side of the shed of the warp yarns.

In order to attain the first object set forth above, the method according to the present invention comprises the steps of stopping the jetting by given auxiliary picking nozzles on the arriving side so that the tip end of the looped inserted weft yarn is limited in the extent to which it moves in the picking direction toward the arriving side of the shed of warp yarns when the weft yarn is inserted in a U-shaped looped into the shed of the warp yarns by the jetting of the main and auxiliary picking nozzles. As a result, the weft yarns are prevented from being caught by a member such as a weft feeler or the like at the looped portion thereof, and the removal operation thereafter is performed with certainty.

It is a second object of the present invention to solve the second problem set forth above, i.e., reversing the pulling direction of the mispicked weft yarn continuous with the weft yarn without providing a specific weft yarn guide in the shed in the process of pulling the weft yarn from the picking side.

In order to attain the aforementioned second object, the method according to the present invention comprises the steps of inserting a weft yarn continuous with a mispicked weft yarn into the same shed as the mispicked weft yarn as a U-shaped loop in an air jet room provided with auxiliary picking nozzles after the mispicking takes place, allowing the weft yarn to fall from the traveling path of the weft yarn by gravity at least by stopping the jetting of the auxiliary picking nozzles so as to let an auxiliary nozzle be relatively located in the U-shaped loop, and reversing the pulling direction of the mispicked weft yarn by way of the auxiliary picking nozzle located in the loop by pulling the weft yarn from the picking side so as to peel the mispicked weft yarn off the cloth fell.

In this way, since the auxiliary picking nozzle is employed as a guide means for pulling the weft yarn continuous with the mispicked weft yarn, the displaceable weft yarn guide member set forth above, and consequently the inserting operation of the same and a driving means for driving the same, are not necessary, so that the construction of the loom can be simplified.

DETAILED DESCRIPTION OF THE PREFERRED EMBODIMENTS

FIRST EMBODIMENT

Figure 1:
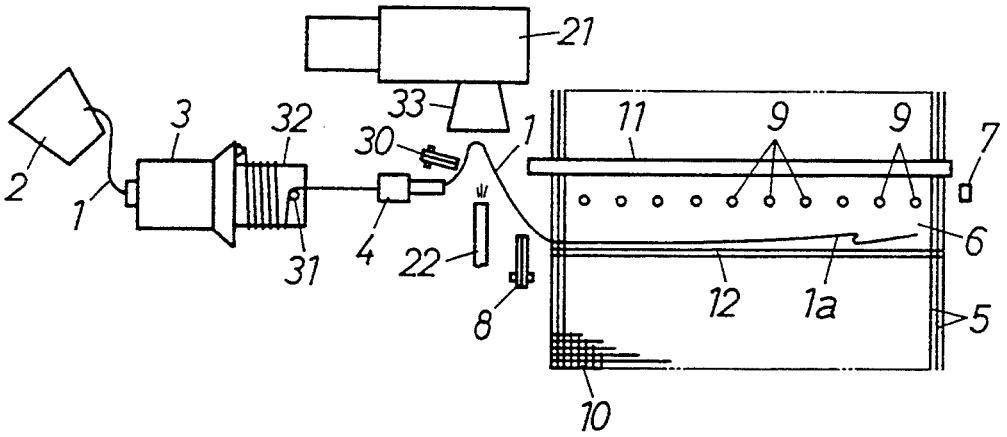
FIGS. 1 to 4 are views for explaining a mispicked weft removing operation according to a first embodiment of the present invention.
Figure 2:
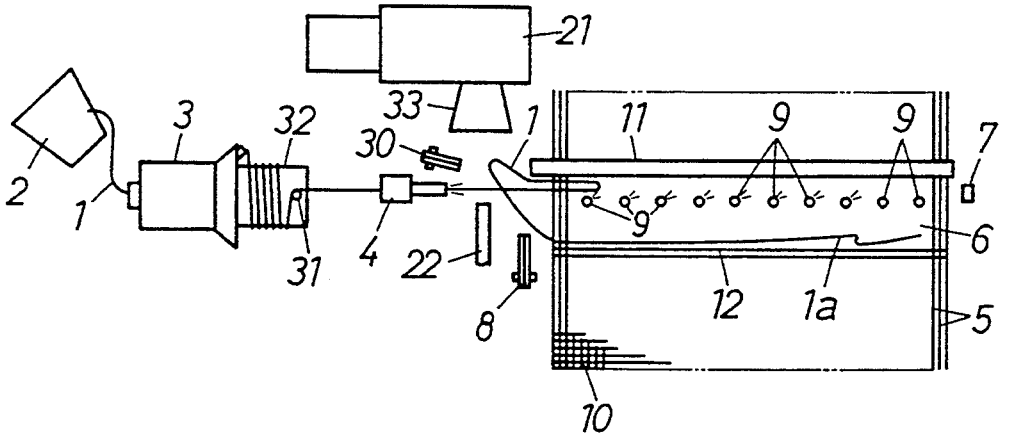

FIGS. 1 to 4 show an operation of the mispicked weft yarn removing method according to a first embodiment of the present invention in relation to a picking operation. The weft yarn 1 supplied by a yarn supply package 2 is measured, for example, for five rolls (i.e. five turns of a drum 32) corresponding to the length of one pick, by a drum type weft measuring and storing device 3 and is stored thereon until the time of picking, when the weft measuring and storing device 3 unwinds the five rolls of the weft yarn 1 and supplies the same to a main picking nozzle 4 on the picking side by retracting the weft yarn retaining pin 31 from the drum 32.

At that time, the main picking nozzle 4 picks the weft yarn 1 which passes therethrough into the shed 6 of warp yarns 5 together with a picking fluid by jetting the same toward the shed 6 of the warp yarns 5. In the picking process, a plurality of auxiliary picking nozzles 9 arranged along the traveling path of the weft yarn 1 in the shed 6 accelerate the weft yarn 1 in the traveling direction thereof by jetting air simultaneously or in relay succession in synchronism with the traveling speed of the weft yarn 1.

A normal picking state is detected by a weft yarn feeler 7 on the arriving side, i.e., on the side opposite the picking side of the loom. The weft yarn feeler 7 detects the tip end of the picked weft yarn 1 and confirms the normal picking state, and thereafter the weft yarn inside the shed 6 is woven into the cloth fell 12 to form a woven fabric 10 by the beating of the reed 11. A feed yarn cutter 8 on the picking side separates the picked weft yarn 1 in the shed 6 from that inside the main picking nozzle 4 by cutting the weft yarn 1 at a location between the main picking nozzle 4 and the picking side of the cloth fell of the woven fabric 10.

When mispicking occurs as illustrated in FIG. 1 in such a picking process, the weft yarn feeler 7 detects the mispicking state and supplies a signal for stopping the picking to a control system (not shown) of the loom. The removal operation of the mispicked weft yarn starts upon reception of the loom stop signal. The first step is to prevent the mispicked weft yarn 1*a* from being separated from the weft yarn 1 inside the main picking nozzle 4 by the feed yarn cutter 8. For example, the main picking nozzle 4 stops its weak continuous jetting, a length of weft yarn 1 is unwound from the weft measuring and storing device 3, a blowing nozzle 22 starts jetting and an air current is generated inside a guide hood 33 of a mispicked weft removing device 21 to draw the mispicked weft yarn 1*a* therein before the feed yarn cutter 8 starts its operation. As a result, the weft yarn 1 located at the tip end portion of the main picking nozzle 4 is blown toward the guide hood 33 of the mispicked weft removing device 21 so as to form a loop and be guided to a position where it is not cut by the feed yarn cutter 8. Thereafter the loom stops adjacent to a first stopping position (260°). In this way the weft yarn 1 supplied by the main picking nozzle 4 is prevented from being cut by the feed yarn cutter 8 and is guided into the guide hood 33 by the blowing operation of the blowing nozzle 22 and the suction operation of the guide hood 33.

Thereafter the loom automatically makes more than a turn in reverse and stops adjacent to a second stopping position (200°). Then the blowing nozzle 22 stops jetting. In this way the mispicked weft yarn 1*a* which is continuous with the weft yarn 1 inside the main picking nozzle 4 is exposed in front of the cloth fell 12 so as to be removable in a so-called pick finding state.

Figure 3:
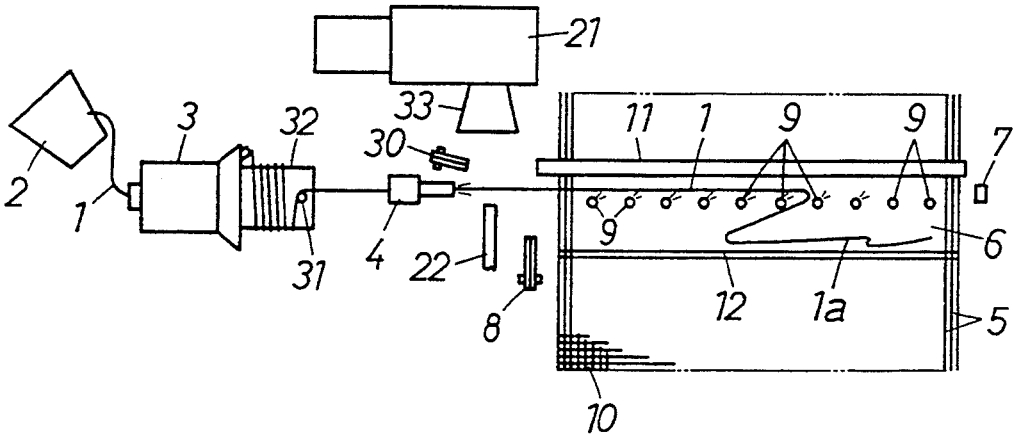

Subsequently, the suction inside the guide hood 33 is stopped, the main picking nozzle 4 and the auxiliary picking nozzles 9 start jetting and the weft measuring and storing device 3 unwinds, for example, three rolls of the weft yarn 1 on the drum 32 thereof so as to insert the unwound weft yarn 1 forming a U-shaped loop into the shed 6 of the warp yarns 5 by the jetting of the main picking nozzle 4 and the auxiliary picking nozzles 9. In the process of inserting the weft yarn 1 in the looped shape, the picking side portion of the mispicked weft yarn 1*a* is peeled off the cloth fell 12 by the pulling force during the inserting operation. In this way, the weft 1 newly inserted into the shed 6 and the mispicked weft 1*a* extend continuously in the shed 6 in a Z-shaped in plan view as shown in FIG. 3, with the tip end portion, i.e., the portion opposite the picking side of the weft 1 newly inserted into the shed 6, folded back toward the arriving side so as to form a U-shaped loop.

In this state, almost all the auxiliary picking nozzles 9 arranged between the picking side and the vicinity of the arriving side of the shed 6 are jetting, but given auxiliary picking nozzles 9 on the arriving side are set to be inactive. The given auxiliary picking nozzles 9 are those of an auxiliary picking nozzle group (an auxiliary picking nozzle group is composed of a pair of auxiliary picking nozzles) which is positioned on the side most opposite to the picking side according to this embodiment. The given auxiliary picking nozzle or nozzles 9 refer to an auxiliary picking nozzle 9 or a group of auxiliary picking nozzles 9 which are deactivated to stop the unnecessary transfer of the weft yarn 1 outside of the shed 6 of the warp yarns 5, and which are other than those which contribute to the transfer of the weft yarn 1 from the picking side to a retaining member 20, described later, in the shed 6. Taking the inertia of the traveling weft yarn 1 into consideration, the auxiliary picking nozzles 9 which contribute to the transfer of the weft yarn 1 do not always include all the auxiliary picking nozzles 9 arranged between the picking side of the shed 6 and the position thereof where the retaining member 20 is provided, but sometimes may include those between the picking side of the shed 6 and a position thereof which is a little short of the retaining pin 20.

Accordingly, the weft yarn 1 which is newly picked for removing the mispicked weft yarn 1*a* is accelerated by the auxiliary picking nozzles 9 which are continuously jetting, but the U-shaped tip end portion thereof which reaches the area of the inactive auxiliary picking nozzles 9 is not further accelerated so that the mispicked weft yarn 1*a* is not further peeled off the cloth fell and is limited in the extent to which it moves in the picking direction since the given auxiliary picking nozzles 9 on the arriving side do not jet. Thus, the weft yarn is not caused to extend substantially beyond the arriving side and, accordingly, does not become entangled with other members such as a weft yarn feeler 7.

Otherwise, the weft yarn 1 may be picked by simultaneously jetting the main picking nozzle 4 and the auxiliary picking nozzles 9 and thereafter retracting the weft yarn retaining pin 31 after starting the jetting, or by retracting the weft yarn retaining pin 31 after starting the jetting, or by retracting the weft yarn retaining pin 31 and allowing a plurality of auxiliary picking nozzles 9 arranged in the traveling direction of the weft yarn 1 to perform jetting in relay succession just after the main picking nozzle 4 starts jetting.

Figure 4:
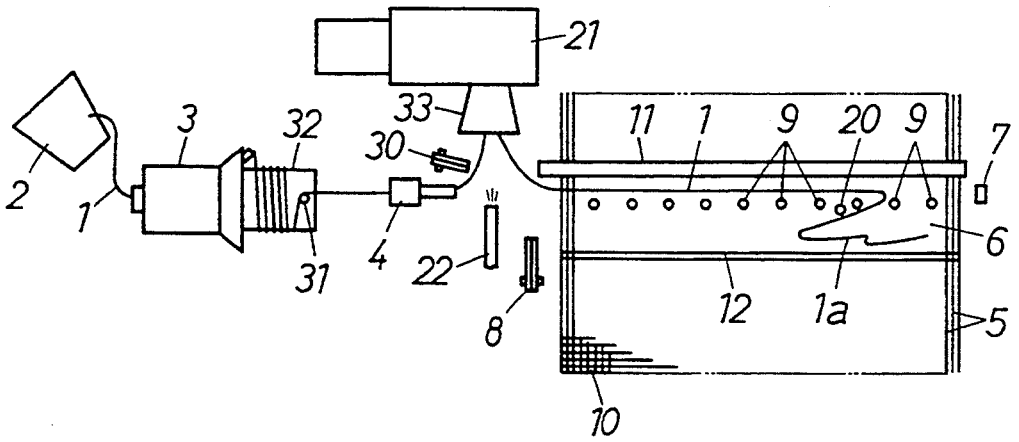
Figure 5:
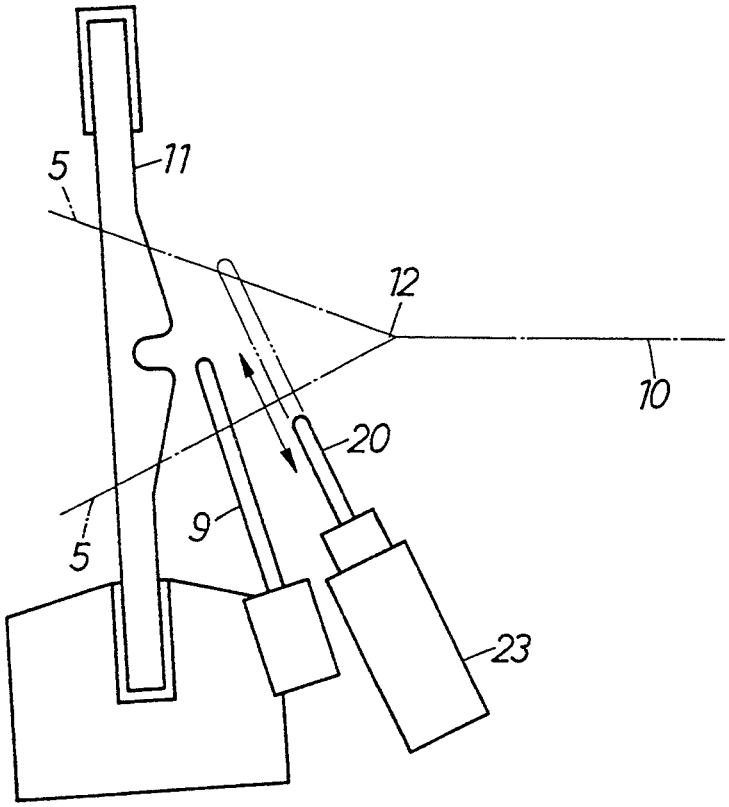
FIG. 5 is an enlarged side view showing a reed, a shed of warp yarns, a weft yarn retaining member and an auxiliary picking nozzle.

Thereafter, the weft yarn retaining member 20 of the weft yarn 1 is inserted into the looped weft yarn 1 in the shed 6 from above the warp yarns 5 or from below the warp yarns 5 as illustrated in FIG. 4. Subsequently the main picking nozzle 4 and the auxiliary picking nozzles 9 stop jetting. The weft yarn retaining member 20 is supported by an operating portion 23 such as the piston rod of a pneumatic cylinder actuator so as to be vertically movable for entering the shed 6 from a standby position when the mispicked weft yarn 1*a* is to be removed.

There is no need to provide a member to be used exclusively as the weft yarn retaining member 20. Rather, an auxiliary picking nozzle 9 located at a position about where the weft yarn 1 is looped can also be used for the weft yarn retaining member 20. In this case, it is sufficient to let the weft yarn 1 drop from the traveling path thereof so as to let one of the auxiliary picking nozzles 9 be positioned in the loop, by stopping the jetting of all the auxiliary picking nozzles 9 or the auxiliary picking nozzles 9 near the arriving side, after the weft yarn 1 is picked in a looped shape. Thus the auxiliary picking nozzle 9 which happened to be inside the loop of the weft yarn 1 can be used as the weft yarn retaining member 20.

Subsequently, the blowing nozzle 22 starts jetting, the weft measuring and storing device 3 releases a length of the weft 1 necessary for removing the mispicked weft 1*a*, the guide hood 33 starts suction and the main picking nozzle 4 has stopped jetting, so that the weft yarn 1 inside the main picking nozzle 4 enters the guide hood 33 due to the air current from the blowing nozzle 22. When a yarn sensor or the like inside the weft yarn removing device 21 detects the entry of the weft yarn 1, the weft yarn removing device 21 holds the weft yarn 1 which has drawn thereinto in preparation for the pulling operation of the weft yarn 1 and the mispicked weft yarn 1*a* continuous therewith. Thereafter, the blowing nozzle 22 stops jetting and the main picking nozzle 4 starts a weak continuous jetting in preparation for cutting the weft yarn 1. At this time, the guide hood 33 stops suction and the cutter 30 at the tip end of the main picking nozzle 4 cuts the weft yarn 1 so that the weft yarn 1 inside the main picking nozzle 4 is separated from the portion for removing the weft yarn 1.

Then the weft yarn removing device 21 pulls the weft yarn 1 from the picking side by a winding or suction operation so as to extract the mispicked weft yarn 1*a* by way of the weft yarn 1 continuous therewith from the cloth fell in a pick finding state. The weft yarn 1 is brought into contact with the weft yarn retaining member 20 and is folded back thereabout, so that the mispicked weft yarn 1*a* is pulled toward the arriving side and is folded back in a hairpin shape in front of the cloth fell 12 and is peeled off therefrom. Upon completion of the extraction, the components which have effected the extraction are stopped or set in a standby state, and the weft yarn 1 and the mispicked weft yarn 1*a* which have been wound up are discharged to a trash box or the like. At that time, the blowing nozzle 22 temporarily performs jetting to help discharge the mispicked weft yarn 1*a*.

Meanwhile, the loom is automatically rotated in reverse to stop adjacent to a third stopping position (300°) for starting a continuous operation. Thereafter the blowing nozzle 22 is set to be inactive and the guide hood 33 stops suction. The continuous operation starts upon reception of the next operating instruction.

Figure 6:
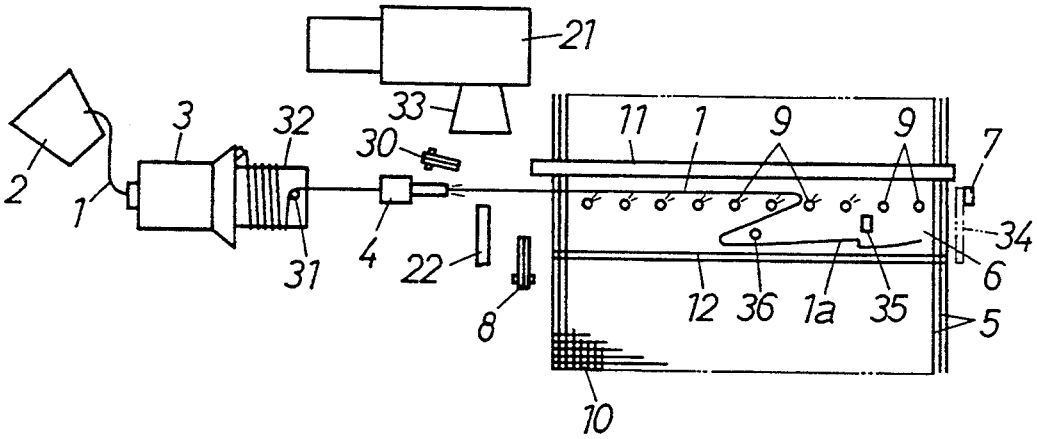
FIG. 6 is a view for explaining a mispicked weft yarn removing operation according to a modification of the first embodiment of the present invention.
Figure 7:
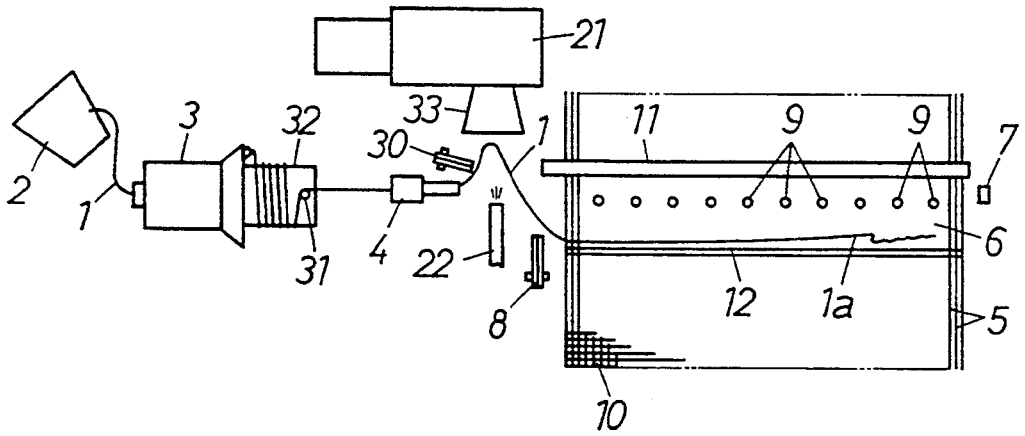
FIGS. 7 to 14 are views for explaining a mispicked weft yarn removing method according to a second embodiment of the present invention.
Figure 8:
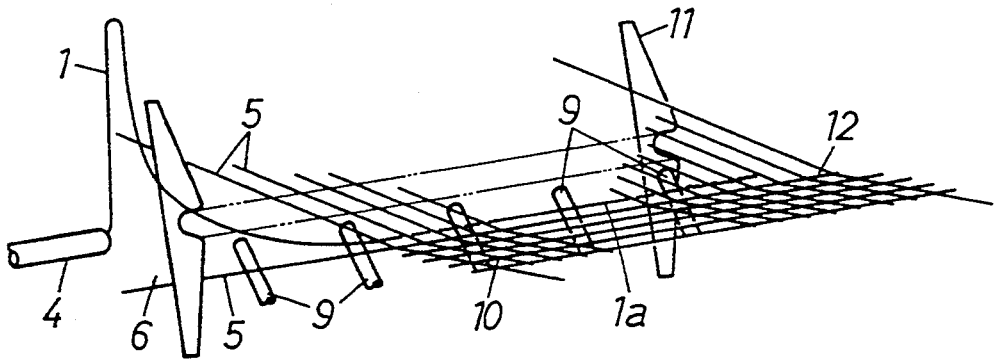
Figure 9:
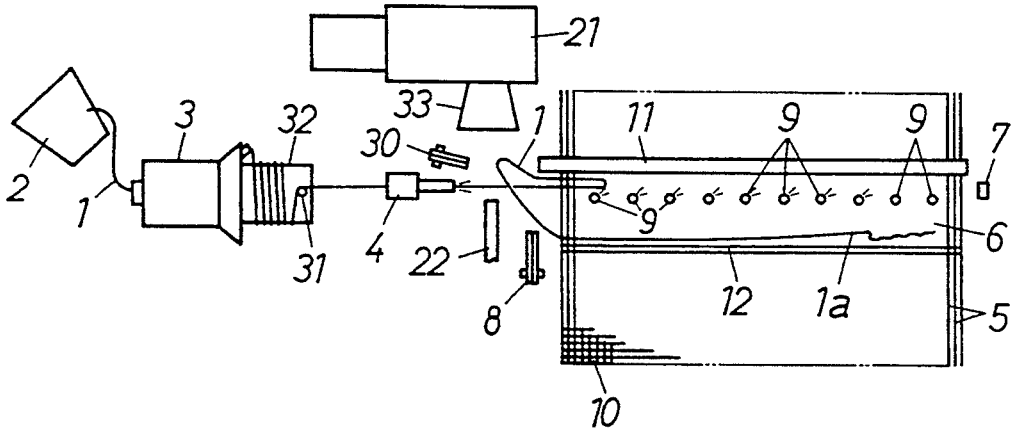
Figure 10:
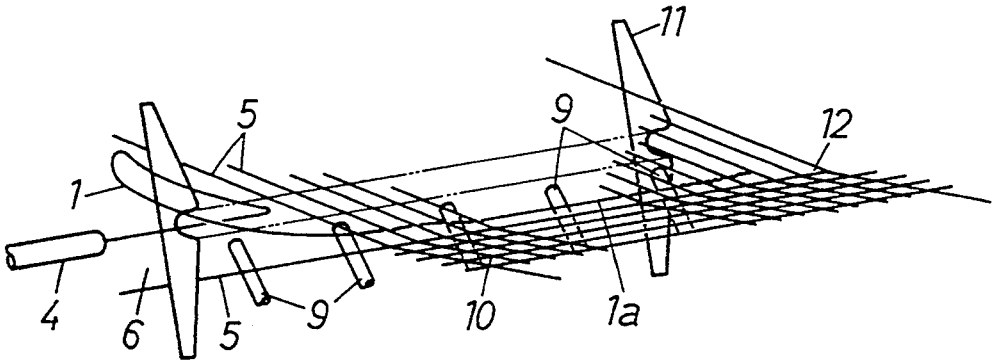
Figure 11:
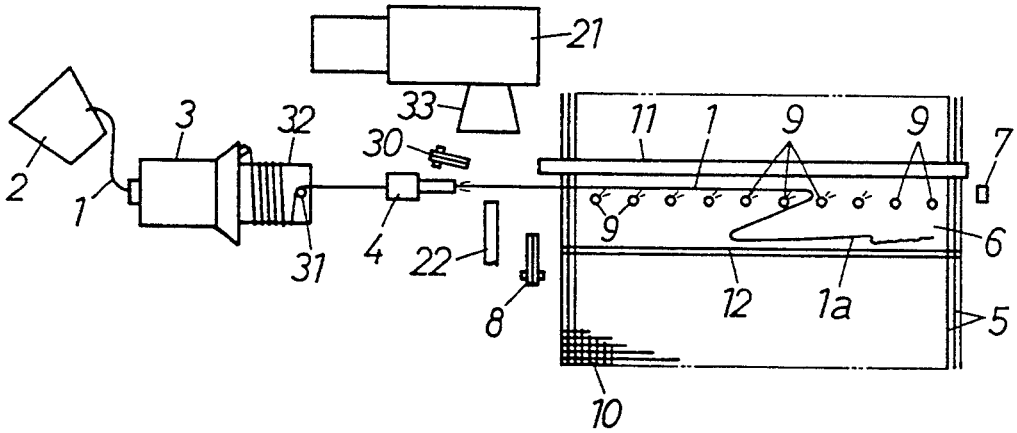

It is preferable to advance a mesh shield plate 34 at least to the extension of the traveling path of the weft yarn 1 on the arriving side of the shed 6 when the weft yarn 1 is picked in the shed 6 in a loop, so as to prevent the weft yarn 1 from going out of the arriving side of the shed 6 and consequently from becoming entangled with numbers such as the weft yarn feeler 7, as exemplified in FIG. 6. When the weft yarn 1 is picked into the shed in a loop, the auxiliary picking nozzles 9 may perform jetting according to the embodiment set forth above or the prior art.

It is also possible to provide a sensor 35 at a proper position adjacent to the traveling path of the weft yarn 1 in the shed 6 of the warp yarns 5 as illustrated in the same FIG. 6 for stopping the jetting of all the auxiliary picking nozzles 9 or given auxiliary picking nozzles 9 on the arriving side relative to the sensor 35 when the same detects the tip end of the looped weft yarn 1. In this way the weft yarn 1 can be limited in the extent that it moves in the picking direction. It is also possible to limit the extent which the weft yarn 1 moves in the picking direction by stopping the jetting of given auxiliary picking nozzles 9 when a given time has passed after the start of inserting the looped weft yarn (at a proper time before the tip end of the looped weft yarn 1 gets out of the shed 6 of the warp yarns 5).

Moreover, it is also possible to insert a stop pin 36 into the shed 6 from above or from below before the weft yarn 1 is inserted in a loop in order to regulate the position where the mispicked weft yarn 1*a* is separated from the cloth fell 12 as illustrated in FIG. 6. According to this method, the mispicked weft yarn 1*a* is retained by the stop pin 36 so that the mispicked weft yarn 1*a* is limited in being separated from the cloth fell 12 and the tip end of the looped portion of the weft yarn 1 does not move toward the arriving side more than necessary, whereby the looped weft yarn 1 is prevented from becoming entangled with members such as the weft yarn feeler 7 on the arriving side.

According to this embodiment, the looped portion of the weft yarn is limited in the extent to which it moves in the picking direction since given auxiliary picking nozzles are stopped when the weft yarn is inserted in a loop in the process of inserting the weft yarn continuous to the mispicked weft yarn in the shed of the warp yarns in a loop and pulling the same to remove the mispicked weft yarn continuous therewith from the picking side while locating a weft yarn retaining member in the loop, so that the weft yarn can be inserted in a loop correctly and the mispicked weft yarn is removed with certainty as the newly inserted weft yarn in a loop is prevented from becoming entangled with other members such as the weft yarn feeler.

Providing the shield plate on the arriving side of the shed on the extension of the traveling path of the weft yarn or inserting a stop pin into the shed of the warp yarns can obtain the same effect as set forth above since the looped portion of the weft yarn can be limited in the extent to which it moves in the picking direction.

SECOND EMBODIMENT

FIGS. 7 to 14 show the operation of a mispicked weft yarn removing method according to a second embodiment of the present invention in relation to a picking operation. The second embodiment uses the auxiliary picking nozzles 9 in place of the movable retaining member 20 in the first embodiment.

Accordingly, it does not matter whether or not given auxiliary picking nozzles 9 on the arriving side are stopped in inserting the weft yarn 1 as in the first embodiment, although the same method as the first embodiment is exemplified for explanation.

As understood from the above description, the difference between the first and second embodiments is that one of the auxiliary picking nozzles 9 is used for movable retaining member 20 according to the second embodiment. Since it has been already described in the first embodiment, only the difference between the two embodiments in drawing will be described hereinafter.

Figure 13:
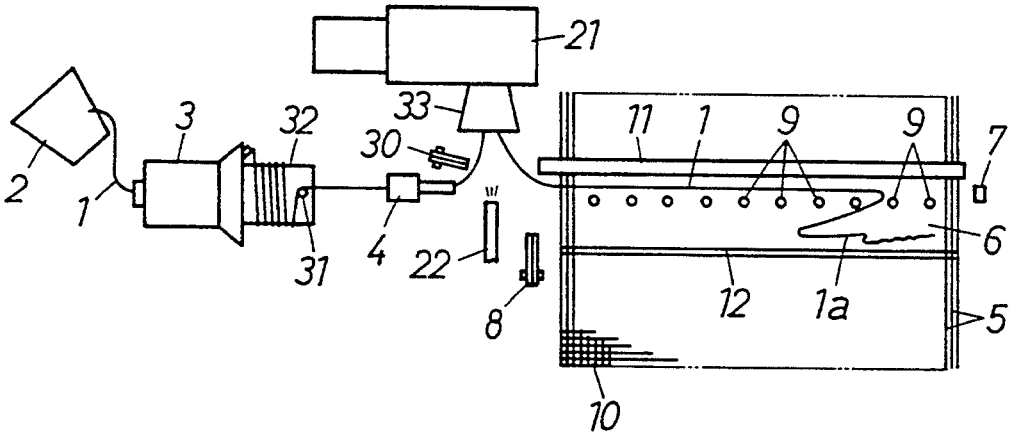

FIGS. 7, 9, 11 and 13 which show the second embodiment respectively correspond to FIGS. 1, 2, 3 and 4 which show the first embodiment, and the difference therebetween is that the movable retaining member 20 which was provided in the first embodiment is not provided in the second embodiment, as evident from FIG. 13.

FIGS. 8, 10, 12 and 14 respectively show the main portions of FIGS. 7, 9, 11 and 13.

Figure 15:
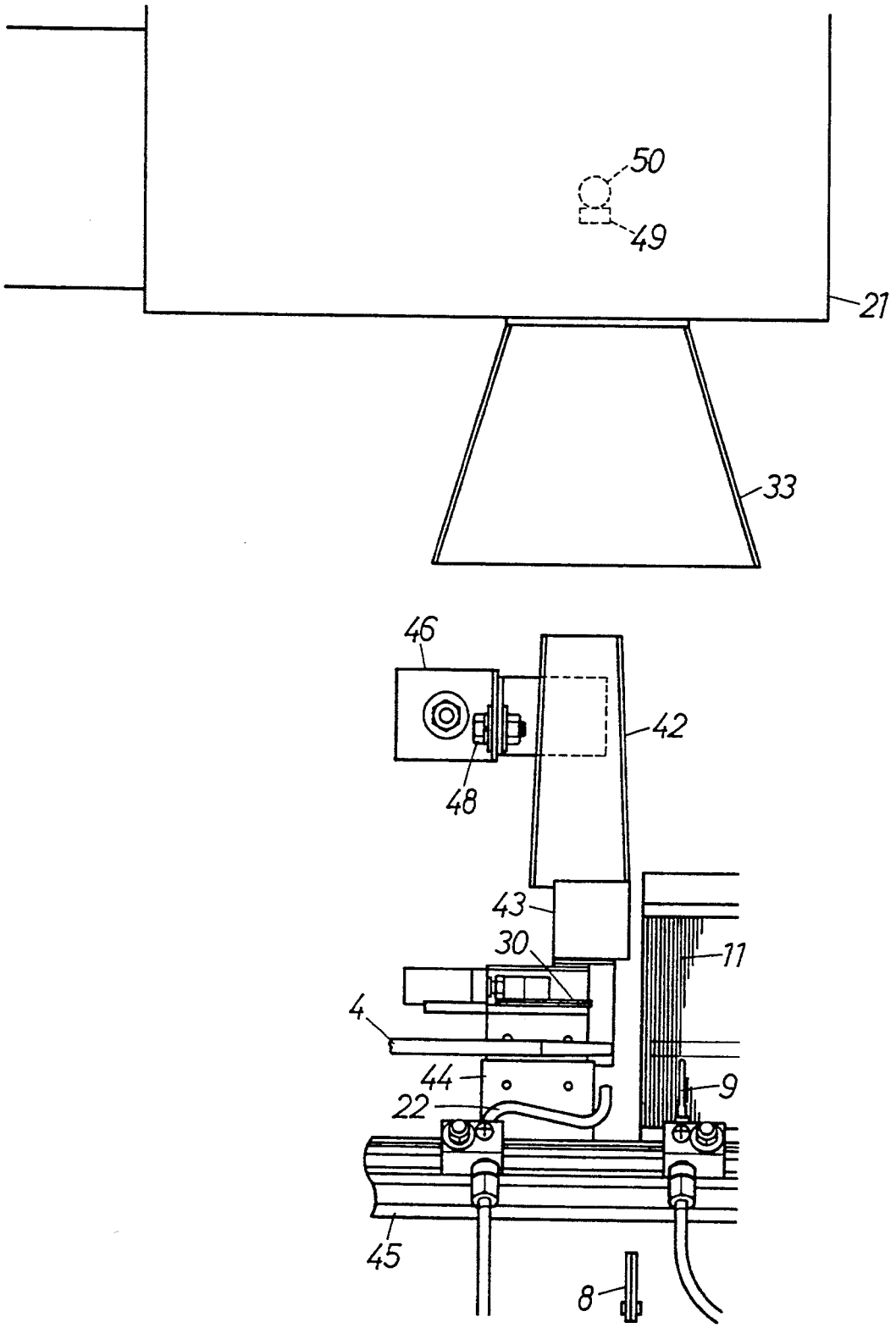
FIG. 15 is an enlarged front view showing a mounting portion on which a blowing nozzle, and an intermediate guide are mounted.
Figure 16:
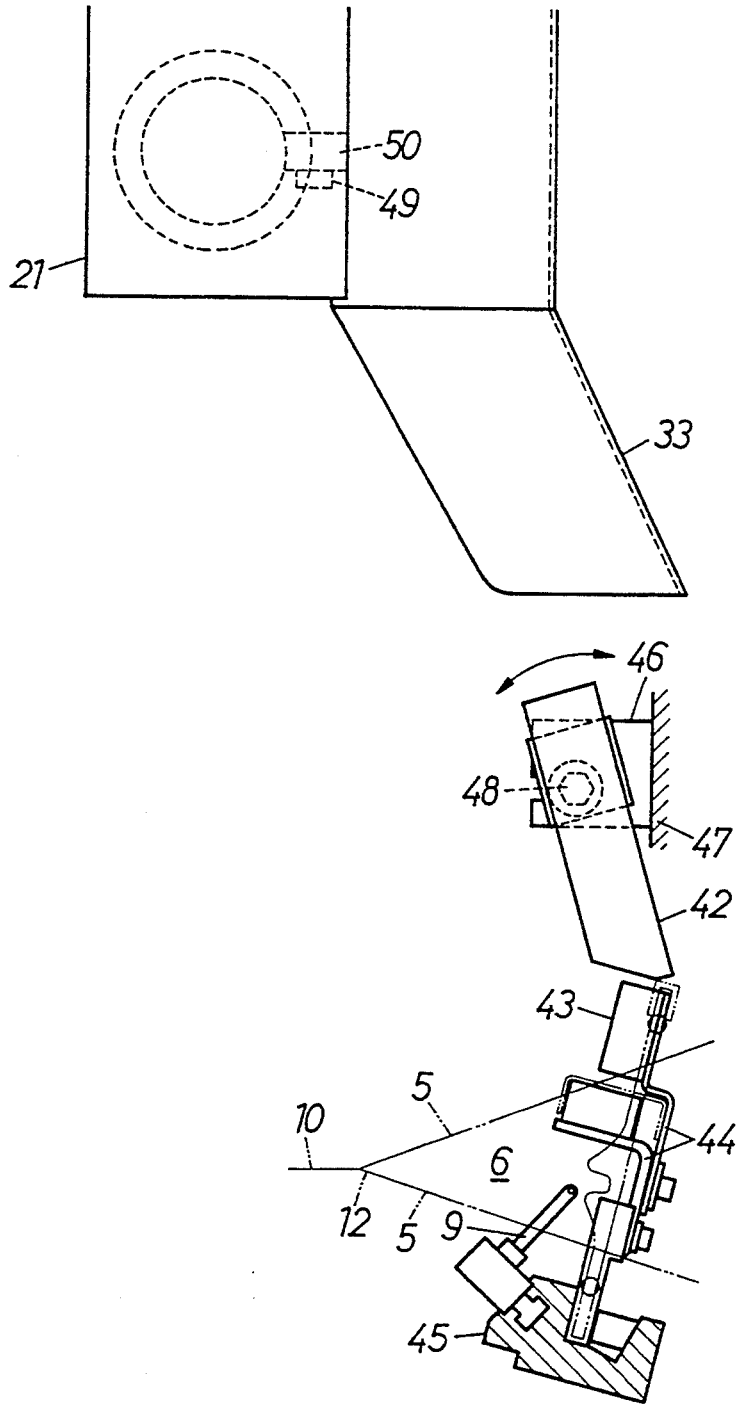
FIG. 16 is an enlarged side view showing a mounting portion on which a blowing nozzle, and an intermediate guide are mounted.

The blowing nozzle 22 and a cylindrical guide 43 are mounted on a rail 45 on the front side of the reed 11 directly or by way of a bracket 44, as illustrated in FIGS. 15 and 16. Particularly the intermediate guide 42, which has a U-shaped cross section with the opening directed toward the front side and is rotatably fixed to a bracket 46 mounted on a loom frame 47 by a horizontal fitting bolt and nut set 48, confronts the upper opening of the cylindrical guide 43 which moves together with the retracted reed 11 at the lower end thereof and confronts the lower opening of the guide hood 33 at the upper end thereof.

When a weft yarn 1 is newly inserted into the shed 6 of the warp yarns 5 for removing the mispicked weft yarn 1*a*, it is recommended to start the insertion by jetting of the main picking nozzle 4 and the auxiliary picking nozzles 9 before the weft yarn 1 which has been blown by the blowing nozzle 22 comes down.

Figure 12:
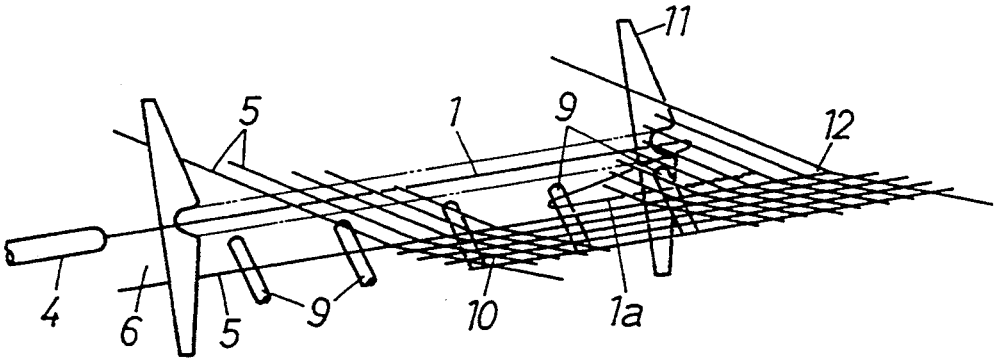

The mispicked weft yarn 1*a* is peeled off the cloth fell 12 at the picking side thereof as it is pulled by the picked weft yarn 1. In this way, the weft 1 newly inserted into the shed 6 and the mispicked weft 1*a* extend continuously in the shed 6 in a Z-shape in plan view as shown in FIG. 12, and the tip end portion, i.e., the portion opposite the picking side of the weft 1 newly inserted into the shed 6, is folded back toward the arriving side so as to form a U-shaped loop.

When the main picking nozzle 4 and the auxiliary picking nozzles 9 stop jetting, the weft yarn 1 and the mispicked weft yarn 1*a* continuous therewith drop by gravity. At that time, an auxiliary picking nozzle 9 enters the U-shaped loop of the weft yarn 1 continuous with the mispicked weft yarn 1*a*. In other words, the weft yarn 1 continuous with the mispicked weft yarn 1*a* lies about the upper portion of the auxiliary picking nozzle 9 on the arriving side forming a U-shaped loop. That is, the auxiliary picking nozzle 9 is disposed inside the loop of the weft yarn 1.

At that time, almost all the auxiliary picking nozzles 9 are performing jetting, but given auxiliary picking nozzles 9, for example, two auxiliary picking nozzles 9, are set to be inactive as necessary. Since the given auxiliary picking nozzles 9 on the arriving side do not perform jetting, the newly picked weft yarn 1, which has been accelerated by the auxiliary picking nozzles 9 which continue jetting, loses the acceleration at the position of the auxiliary picking nozzles which are inactive so that it is limited in the extent to which it moves in the picking direction.

Figure 14:
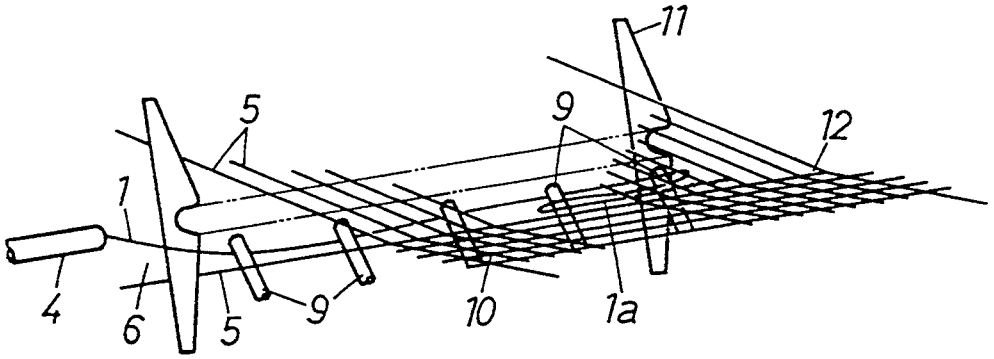

The weft yarn removing device 21 pulls the weft yarn 1 from the picking side by winding or by suction to extract the mispicked weft yarn 1*a* by way of the weft yarn 1 continuous therewith from the cloth fell 12 in the picking state as illustrated in FIGS. 13 and 14. In the course of the extraction, the weft yarn 1 is folded back as it comes into contact with an auxiliary picking nozzle 9 so that it is pulled in a reverse direction. As a result, the mispicked weft yarn 1*a* is always extracted from the arriving side, so that the mispicked weft yarn 1*a* is folded back in a hairpin shape at the cloth fell 12 and extracted therefrom by a force applied thereto in the direction to separate the same from the cloth fell 12. Since the position where the loop of the weft yarn 1 is formed can be previously set by the released length of the weft yarn 1, the auxiliary picking nozzle 9 for folding back the weft yarn 1 can be specified. At that time, the folded back weft yarn 1 can correspond to the auxiliary picking nozzle 9 with certainty by mounting the specified auxiliary picking nozzle higher than the other auxiliary picking nozzles 9.

The weft yarn 1 is blown upwardly to prevent the mispicked weft yarn 1*a* from being cut by the feed yarn cutter 8 according to the first and second embodiments set forth above, but the well-known method such as stopping the operation of the feed yarn cutter 8 per se or interposing a shield plate in the operating area of the feed yarn cutter 8 may be employed instead.

In the same way, the weft yarn is blown upwardly to introduce the same continuous with the mispicked weft yarn into the weft yarn removing device according to the aforementioned embodiment, which may be replaced by a well-known method. The weft yarn removing device 21 is not limited to the winding type so long as it draws the weft yarn from the picking side.

When the weft yarn 1 is picked in a loop, it is also possible to provide auxiliary picking nozzle type picking nozzles 9 on the arriving side directed opposite the traveling direction of the weft yarn 1, i.e., the picking side, which jet only when the weft yarn 1 is picked in a loop so as to limit the extent to which the tip end of the weft yarn 1 moves in the picking direction. A retaining member may be mounted on the rail 45 in the same way as the auxiliary picking nozzle 9 instead of using the auxiliary picking nozzle 9 per se as the retaining member. In this case, it is advantageous that the retaining member has a shape similar to the auxiliary picking nozzle 9 and projects at a position higher than the auxiliary picking nozzle 9 for protecting the warp yarns from being injured in weaving.

Since the auxiliary picking nozzle located in the U-shaped loop of the weft yarn reverses the drawing direction of the weft yarn according to the aforementioned embodiment, there is no need to have a specific member for reversing the drawing direction of the weft yarn and there is also no need to have a driving means for vertically moving the specific member, such that the construction can be simplified. Even if the weft yarn is not retained by the target auxiliary picking nozzle in the shed in the process of drawing the weft yarn, any of a plurality of auxiliary picking nozzles arranged in the picking direction of the weft yarn can be located inside the loop of the weft yarn so as to serve as a retaining member, which eliminates the improper correspondence between the looped weft yarn and the yarn guide and makes the weft yarn removing operation more certain.

What is claimed is:

1. A mispicked weft removing method comprising the steps of:

after mispicking of a weft yarn in a shed of warp yarns occurs, inserting a looped weft yarn, which is continuous with the mispicked weft yarn, from a main picking nozzle into the shed of warp yarns from a picking side toward an arriving side thereof by jetting of said main picking nozzle and auxiliary picking nozzles;

pulling the weft yarn from the picking side while locating a retaining member in a loop of the looped weft yarn in the shed of warp yarns; and during picking of the looped weft yarn, stopping the jetting of given ones of said auxiliary picking nozzles adjacent said arriving side to limit an extent to which the weft yarn is transferred in a picking direction from said picking side to said arriving side.

2. A mispicked weft removing method comprising the steps of:

after mispicking of a weft yarn in a shed of warp yarns occurs, inserting a looped weft yarn, which is continuous with the mispicked weft yarn, from a main picking nozzle into the shed of warp yarns from a picking side toward an arriving side thereof by jetting of said main picking nozzle and auxiliary picking nozzles;

pulling the weft yarn from the picking side while locating a retaining member in a loop of the looped weft yarn in the shed of warp yarns; and during picking of the looped weft yarn, providing a shield plate on the arriving side of the shed of warp yarns along a traveling path of said weft yarn to limit an extent to which the weft yarn is transferred in a picking direction from said picking side to said arriving side.

3. A mispicked weft removing method comprising the steps of:

after mispicking of a weft yarn in a shed of warp yarns occurs and the mispicked weft yarn becomes at least partially integrated with a cloth fell, inserting a looped weft yarn, which is continuous with the mispicked weft yarn, from a main picking nozzle into the shed of warp yarns from a picking side toward an arriving side thereof by jetting of said main picking nozzle and auxiliary picking nozzles;

pulling the weft yarn from the picking side while locating a retaining member in a loop of the looped weft yarn in the shed of warp yarns, to cause the mispicked weft yarn to be separated from the cloth fell; and regulating a position at which the mispicked weft yarn is separated from the cloth fell by inserting a stop pin into the shed of warp yarns at a position upstream of said retaining member with respect to a weft yarn picking direction from said picking side to said arriving side, to limit an extent to which the weft yarn is transferred in said picking direction.

4. A mispicked weft removing method as recited in claim 3, wherein the position at which said stop pin is inserted into the shed of warp yarns is located closer to said cloth fell than is said retaining member.

5. A mispicked weft removing method as recited in claim 3, wherein in regulating the position at which the mispicked weft yarn is separated from the cloth fell, the position is regulated to not move toward said arriving side beyond a predetermined location.

6. A mispicked weft removing method as recited in claim 5, wherein the position at which said stop pin is inserted into the shed of warp yarns is located closer to said cloth fell than is said retaining member.

7. A mispicked weft removing method comprising the steps of:

after mispicking of a weft yarn in a shed of warp yarns occurs, inserting a looped weft yarn, which is continuous with the mispicked weft yarn, from a main picking nozzle into the shed of warp yarns from a picking side toward an arriving side thereof by jetting of said main picking nozzle and auxiliary picking nozzles;

stopping the jetting of said auxiliary picking nozzles so as to allow said looped weft yarn to drop by gravity, such that one of said auxiliary picking nozzles can be located in a loop of said looped weft yarn; and removing the mispicked weft yarn by pulling the weft yarn from said picking side such that the mispicked weft yarn is caused to fold back about said one of said auxiliary picking nozzles.

* * * * *